US009138018B1

(12) United States Patent
Walmsley

(10) Patent No.: US 9,138,018 B1
(45) Date of Patent: Sep. 22, 2015

(54) HANDHELD WATER PIPE FOR FILTERING SMOKE

(76) Inventor: Linda Walmsley, Denver, CO (US)

( * ) Notice: Subject to any disclaimer, the term of this patent is extended or adjusted under 35 U.S.C. 154(b) by 715 days.

(21) Appl. No.: 13/552,175

(22) Filed: Jul. 18, 2012

(51) Int. Cl.
*A24F 1/30* (2006.01)

(52) U.S. Cl.
CPC ..... *A24F 1/30* (2013.01)

(58) Field of Classification Search
CPC ..... A24F 1/00; A24F 1/02; A24F 1/04; A24F 1/06; A24F 1/08; A24F 1/10; A24F 1/16; A24F 1/18; A24F 1/20; A24F 1/22; A24F 1/30; A24F 3/00; A24F 3/02; A24F 13/02
USPC ..... D27/162; 96/243, 267, 278, 279, 321, 96/329, 372, 375; 215/387; 261/30
See application file for complete search history.

(56) References Cited

U.S. PATENT DOCUMENTS

| | | | | | |
|---|---|---|---|---|---|
| 3,872,872 | A * | 3/1975 | Kahler | ..... | 131/173 |
| D245,343 | S | 8/1977 | Kahler | | |
| 4,165,753 | A * | 8/1979 | Stryker | ..... | 131/173 |
| 4,638,815 | A | 1/1987 | Yoshioka | | |
| 4,682,610 | A * | 7/1987 | Freelain | ..... | 131/173 |
| D349,780 | S | 8/1994 | Heine | | |
| 5,476,110 | A | 12/1995 | Baig et al. | | |
| 2011/0186064 | A1 * | 8/2011 | Patel | ..... | 131/328 |

* cited by examiner

*Primary Examiner* — Richard Crispino
*Assistant Examiner* — Eric Yaary
(74) *Attorney, Agent, or Firm* — The Reilly Intellectual Property Law Firm, P.C.

(57) ABSTRACT

A handheld water pipe for smoking herbal products is made up of a water chamber filled to a predetermined level with water, a downstem extending from a bowl containing tobacco or other herbal smoking product in an upper external surface of the chamber and the downstem having openings at its lower end submerged in the water, a second interior stem having an entrance flush with the external wall surface and spaced from the bowl, the stem terminating in one or more openings within the chamber and above the water level, and a carburetor opening in the outer wall of the chamber spaced from the other openings into the interior of the chamber.

16 Claims, 2 Drawing Sheets

22
30
38
20

10
38
22
20
30
12
15

22
12
30
15

22
12
30

22
24
30

38
22
28
30
20
12

38
22
28
20
30

HANDHELD WATER PIPE FOR FILTERING SMOKE

BACKGROUND AND FIELD OF INVENTION

This invention relates generally to smoking accessories, and more particularly relates to a novel and improved pocket-sized water pipe for filtering smoke from tobacco or other herbal smoking products.

Water pipes, and in particular, those decorative versions known as "bubblers" which are made out of glass are employed to smoke tobacco and other herbal smoking substances by filtering the smoke through water. The water pipe is constructed with a water chamber which can be filled with an appropriate amount of water, and tobacco is placed into a bowl at the upper end of the chamber. A user then places a finger over a carburetor opening in the wall of the chamber and the tobacco is ignited while the user draws air through a mouthpiece externally connected to the chamber through a stem. Smoke from the burning tobacco in the bowl enters via a downstem, passes through the water reservoir and is drawn upwardly through the stem of the mouthpiece and into the user's mouth while removing the finger from the carburetor. The finger is not released from the carburetor until the chamber is filled with smoke and then is drawn out through the mouth by virtue of air passing through the mouthpiece and through the carburetor. Conventional water pipes are cumbersome and when miniaturized for portability can cause the water to enter the user's mouth and create the potential for facial burns.

Accordingly, there is a need for a water pipe for smoking tobacco and the like that can be handheld and readily fit into a pocket or purse and in use prevents water ingestion while minimizing the danger of facial burns. In addition, it is desirable to eliminate external stems and other appendages while minimizing the number of steps required to manufacture.

SUMMARY OF INVENTION

It is therefore an object to overcome the aforementioned problems associated with prior glass water pipes by devising a pocket or travel-sized water pipe that is portable, easy to use and, if properly used, avoids the risk of burns to the hands or face of the user while eliminating the risk of water ingestion.

It is another object to provide for a novel and improved water pipe for filtering tobacco smoke through an extremely small water chamber and is readily conformable for use in filtering smoke from various ignitable substances other than tobacco.

It is a still further object to provide for a novel and improved water pipe made of glass and which can be constructed in various sizes while eliminating external appendages normally required by virtue of its size, shape, mouthpiece placement, modified stem placement and orientation as well as the downstem orientation by virtue of a greatly simplified manufacturing process.

Another feature is the shape of the chamber which is best described geometrically as being an oblate spheroid or oval shape meaning that two opposite poles of a hollow spherical matrix are forced inwardly toward one another or flattened between an outer peripheral wall portion. In the following detailed description, any reference to location of stems or openings at different clock positions are intended to be approximate and may vary in either direction away from the position given.

DETAILED DESCRIPTION OF THE DRAWINGS

DETAILED DESCRIPTION OF FIRST EMBODIMENT

Figure 1:
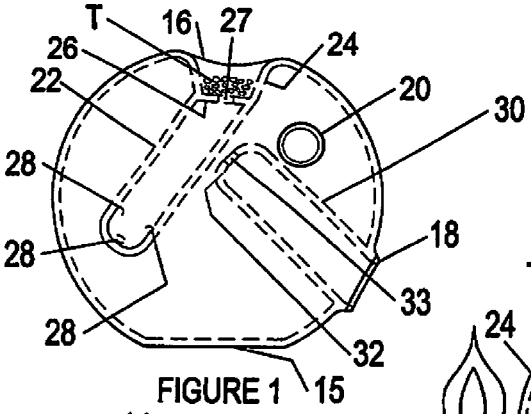
FIG. 1 is a front view of a first embodiment of water pipe.
Figure 2:
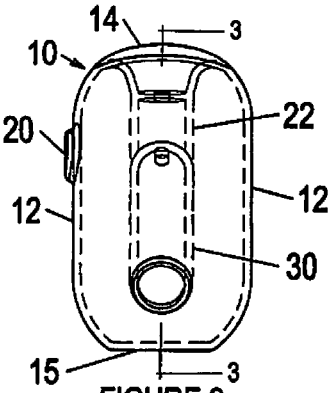
FIG. 2 is a right side view in elevation of FIG. 1.

Referring in detail to FIGS. 1-4 and 6-12, there is shown a small, portable water pipe having an outer housing in the form of a chamber 10 for smoking tobacco which can be made of various sizes but preferably is of a size small enough to be carried in a pocket or purse. In use, it can be carried in one hand, and its functional design prevents facial burns and water from entering the user's mouth while effectively filtering out many harmful substances from the smoke by causing it to be bubbled through the water which partially fills a lower end of the chamber 10. Preferably, the chamber 10 has opposite, substantially flat side walls 12 and an outer generally circular wall 14 joining the side walls 12 together and terminating in a bottom wall surface 15. Geometrically, the chamber 10 may be best described as an oblate spheroid and, when formed from a hollow glass sphere would have opposite poles flattened under the application of heat into opposite side walls 12, and a bottom surface of the outer wall 14 would be flattened into the bottom surface portion 15 of the unitary, hollow chamber 10. First and second openings 16 and 18 are formed in circumferentially spaced relation to one another in the outer wall 14, the opening 16 being approximately at the twelve o'clock position and the opening 18 being approximately in the four o'clock position. A third opening 20 is formed in a sidewall 12 intermediately between the opening 16 and 18 for a purpose to be described. A first hollow stem 22, commonly referred to as a diffuser downstem, extends downwardly from the first opening 16 into the interior of the chamber spaced intermediately between the side walls 12 and side walls and is inclined or oriented somewhat toward the eight o'clock position of the chamber 10 and has an upper generally bowl-shaped, tobacco-receiving terminal end 24 directed inwardly from the outer wall 14. A circular disk 26 with opening 27 is disposed at the juncture of the downstem 22 and the bowl 24 to serve as the bottom or base of the bowl to retain the tobacco particles in the bowl while permitting smoke from the ignited tobacco to pass downwardly through the opening 27 and pass through the openings 28 in the lower end of the downstem 22.

A second interior glass stem 30 is inserted through the second opening 18 spaced intermediately between the side walls 12 and inclined or directed upwardly to terminate in a rounded end 32 having a central opening 33, the second stem being oriented at an angle toward the eleven o'clock position and terminating in spaced relation to the downstem 22. The entrance end of the stem 30 is formed with a slight rounded rim or protrusion 36 defining a mouthpiece for the stem 30.

In glass-making jargon, the chamber 10 is formed by "pulling a point" from glass tubing and is manipulated in a high intensity flame to the desired shape. The hollow stems 22 and 18 are cut to length from the appropriate sized tubing and are welded in a high intensity flame to the chamber 10. Similarly, the carburetor opening 20 is formed in the same manner but without necessity of a stem but with a slight rounded protrusion or rim on the external surface of the sidewall 12.

In practice, a user as represented at S will partially fill the chamber 10 through the carburetor opening 20 with an appropriate amount of water W and place tobacco as represented at T in the bowl 24 then place a finger over the carburetor 20. The user's lips are placed on the mouthpiece opening 36 and the user manually tilts the chamber 10 upwardly to force the bowl 24 away from the user's face. The user then applies a flame as represented at F to the bowl and sucks on the mouthpiece 36 to draw the flame F into the bowl 24 to ignite the tobacco T. Smoke from the burning tobacco is drawn through the downstem 22 which has its lower end submerged in the water W so that the smoke passes through the water reservoir 10 and collects in the chamber above the water line. The user continues to suck on the mouthpiece 36 until the chamber is filled with smoke and then removes the finger from the carburetor 20 while continuing to suck on the mouthpiece 36 to inhale the smoke from the chamber 10.

Figure 3:
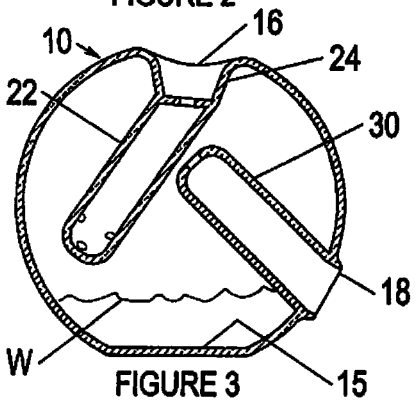
FIG. 3 is a cross-sectional view taken about lines 3-3 of FIG. 2 and with the internal parts being sectioned to represent different colors.
Figure 4:
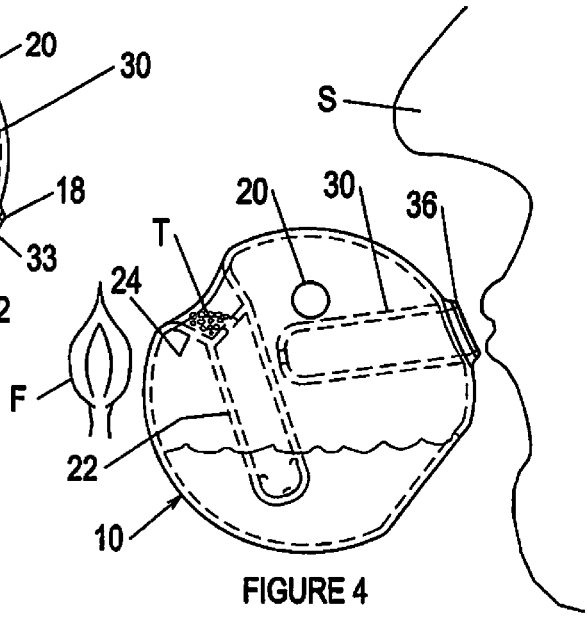
FIG. 4 is a front view in elevation of FIG. 1 tilted into the use position.

It is to be noted that the stem 30 projects inwardly through the inside of the water pipe as opposed to protruding outwardly from the external surface and which, in conjunction with the inset rounded bowl 24 and its inwardly projecting downstem 22, eliminates any substantial protrusion which could easily be subject to breakage if stored in a pocket or purse. Still further, the placement of the stem 30 and its upward orientation when the chamber is placed on a flat surface prevents water from entering the end of the stem 30; and when the chamber is tilted as illustrated in FIG. 4 will submerge the lower end of the downstem 22 in the water while raising the stem well above the water level to place the bowl 24 a safe distance from the user's face. The reorientation of the downstem 22 to approximately the eight o'clock position allows it to remain submerged in the water reservoir when the chamber is tilted forwardly while in use. The flattened bottom surface 15 allows the unit to stand in an upright position when not in use and during the filling process; or the chamber 10 may be laid on its side in filling through the opening 20. In this regard, FIG. 3 illustrates the water level well below the lower end of the downstem 30 but it will be readily apparent that it can be filled to a higher level at or above the lower end of the downstem 22 without permitting water to enter the stem 30. Also the chamber 10 can stand up or be laid on its side without losing water after use; and after draining the water through the carburetor opening 20 can be placed in one's pocket or purse, for example, without leakage.

DETAILED DESCRIPTION OF SECOND EMBODIMENT

Figure 5:
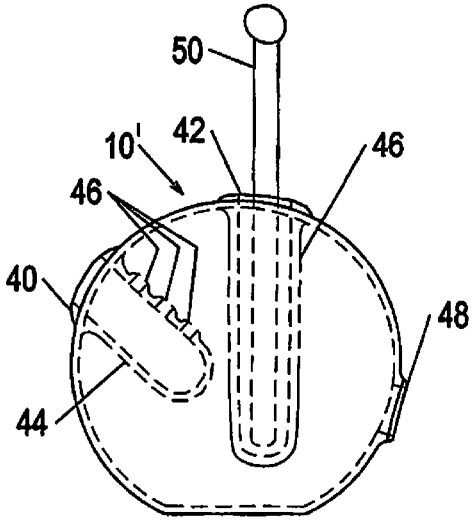
FIG. 5 is a front view of a second embodiment of a water pipe.
Figures 6, 7, 8, 9, 10, 11, 12:
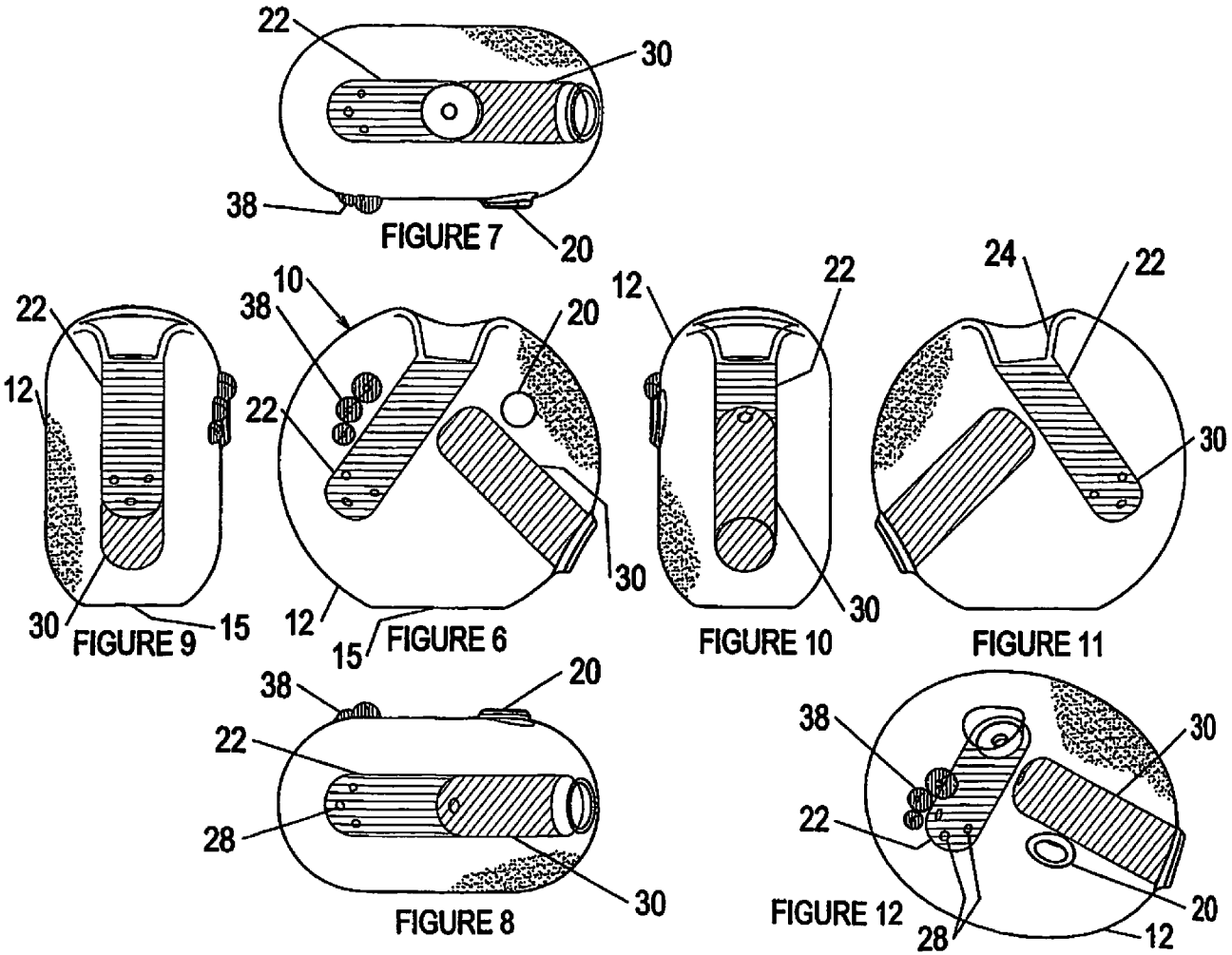
FIG. 6 is a front view of the first embodiment illustrating color features thereof.
FIG. 7 is a top plan view of FIG. 6.
FIG. 8 is a bottom plan view of FIG. 6.
FIG. 9 is a left side view in elevation of FIG. 6.
FIG. 10 is a right side view of FIG. 6.
FIG. 11 is a rear view in elevation of FIG. 6.
FIG. 12 is a perspective view of FIG. 6.

A second embodiment is illustrated in FIG. 5 wherein a chamber 10' corresponding in configuration to the chamber 10 of the first embodiment is once again in the form of a pocket-sized oblate spheroid having circumferentially spaced openings 40 and for internal stems 44 and 46 and a mouthpiece opening 48. The stem 40 extends downwardly and somewhat inwardly from a ten o'clock position to a five o'clock position and has a series of openings 46 in axially spaced relation along one side of the stem 40 which is oriented toward the top of the chamber. The stem itself is designed to function as a reservoir for different substances, such as, tobacco, herbs or oils which are located within the stem 44 in a side of the chamber opposite to the mouthpiece 48. The stem 46 extends vertically in a downward direction from a twelve o'clock position over the greater diameter of the chamber 10' and serves as a receptacle for a glass rod 50 when not in use. However, when in use, the rod 50 is heated to a high temperature and inserted into the stem 44 for the purpose of vaporizing the contained substances in the stem, such as, tobacco, herbs, etc. Once vaporized in the stem the vapors can be ingested by the user placing their lips over mouthpiece 48 and drawing the vapors through the chamber 10'.

In the manufacture of the second embodiment 10', once again a point is pulled and manipulated in high intensity flame into the desired shape. The stems 44 and 46 are welded in place so as to be fully inserted into their respective openings 40 and 42. The stem 42 serves as a holder or receptacle for the glass rod 50 when not in use. Once the rod is cooled sufficiently it may be removed and separately stored. No carburetor is necessary since the vapors are captured and delivered to the user through the mouthpiece. Thereafter, air pulled through the reservoir or stem 44 will clear or remove all of the vapors from the chamber 10'.

DETAILED DESCRIPTION OF THIRD EMBODIMENT

FIGS. 6-12 illustrate a third embodiment which is of the same construction as FIGS. 1-4 but illustrate the utilization of different colored stems 22 and 30 mounted within a clear or transparent chamber 10 for the purpose of visually distinguishing each stem to the user while at the same time presenting a distinctive, ornamental design. For example, the stem 22 is cross-sectioned with the color symbol for the color blue and the stem 30 is cross-sectioned to represent the color orange. In addition, marble shaped protrusions 38 may also be dyed of a particular color and are essentially in the form of glass marbles bonded or welded to the external surface of the chamber. In this respect, the marbles 38 provide a certain utilitarian function in gripping the external surface of the chamber when in use as well as serving as a locator or identifier of the downstem 22.

It will be understood that various modifications and changes may be made to the embodiments herein described without departing from the spirit and scope thereof. For example, the inner stems may be of different colors or simply may be of clear glass; and the external configuration of the chamber may be modified so that the outer peripheral wall is of various polygonal configurations rather than being rounded. It is therefore to be understood that the invention may be practiced otherwise than as specifically described while remaining within the scope of the appended claims.

I claim:

1. In a water pipe of the type having a chamber partially filled to a predetermined level with water, the combination therewith comprising:

a first interior downstem extending from a bowl containing tobacco and wherein an entrance to said bowl is substantially flush with an upper external surface of said chamber, and said downstem being hollow with openings at its lower distal end submerged in the water;

a second interior stem having an entrance at one end substantially flush with an external wall surface of said chamber, said second stem being hollow and terminating in an inner distal end provided with one or more openings within said chamber and above the water level; and a separate carburetor opening substantially flush with an outer wall of said chamber.

2. In a water pipe according to claim 1 wherein said chamber is of generally spherical configuration.

3. In a water pipe according to claim 2 wherein said chamber is glass which is formed into an oblate spherical configuration defining an outer circular wall and unitary opposite substantially flat side walls.

4. In a water pipe according to claim 3 wherein said first and second stems are mounted in circumferentially spaced relation to one another for inward extension from said outer wall.

5. In a water pipe according to claim 4 wherein a bottom surface portion of said outer wall is substantially flat.

6. In a water pipe according to claim 5 wherein said second stem is inclined upwardly with respect to said bottom surface toward said inner distal end.

7. In a water pipe according to claim 1 wherein said first interior downstem and bowl extend from an imaginary twelve o'clock position of said chamber.

8. In a water pipe according to claim 1 wherein said second interior stem inclines upwardly from an approximate four o'clock imaginary position on said chamber.

9. A portable water pipe for smoking herbal smoking products comprising:

a water chamber of generally oblate spherical configuration having an outer circular peripheral wall and opposite, substantially flat side walls, said circular wall provided with a substantially flat bottom wall portion; and first and second hollow stems extending from circumferentially spaced entrances in substantially flush relation to said outer circular wall, wherein said first stem extends downwardly from an upper surface of said circular wall and said second stem extends upwardly from a lower surface portion of said circular wall and wherein each of said stems is provided with one or more openings at their inner distal ends.

10. A water pipe according to claim 9 wherein a third opening is provided in one of said side walls above said second stem.

11. A water pipe according to claim 9 wherein said chamber walls are composed of clear glass and said stems are composed of colored glass.

12. A water pipe according to claim 9 wherein said chamber is in the form of an oblate spheroid.

13. A handheld portable water pipe for smoking herbal smoking products comprising:

a water chamber having opposite, substantially flat side walls and an outer generally circular wall joining said side walls together and terminating in a bottom wall surface;

said circular wall having first and second openings in circumferentially spaced relation to one another;

a first hollow stem extending downwardly from said first opening into the interior of said chamber and having an entrance end flush with said circular wall and having an upper generally bowl-shaped tobacco-receiving terminal end and a lower end with one or more openings therein terminating above said bottom wall surface;

a second hollow stem extending upwardly from said second opening into the interior of said chamber and having an entrance end flush with said circular wall and an opposite terminal end provided with one or more openings therein; and a third opening in one of said side walls and circular wall whereupon filling said water chamber to a level above said lower end of said first hollow stem and igniting a substance placed in said bowl while covering said third opening and tilting said second stem above the water level prevents water from entering said second stem when suction is applied through said second stem to draw smoke from the ignited substance upwardly through the water to fill the chamber above the water level followed by the removal of the smoke from the chamber through said second hollow stem.

14. In a water pipe according to claim 13 wherein said chamber walls are composed of a thin-walled transparent glass and said stems are each composed of colored glass.

15. In a water pipe according to claim 13 wherein said first opening is approximately at an imaginary twelve o'clock position in said circular wall and said second opening is approximately at an imaginary four o'clock position in said wall.

16. In a water pipe according to claim 13 wherein said opening is positioned in one of said side walls above said second stem.

* * * * *